United States Patent [19]

Thayer et al.

[11] Patent Number: 4,819,031

[45] Date of Patent: Apr. 4, 1989

[54] ROTATING VANE TONER TRANSPORT FOR BLADE CLEANING ON HORIZONTAL SURFACES

[75] Inventors: Bruce E. Thayer; David R. Wyble, both of Webster, N.Y.

[73] Assignee: Xerox Corporation, Stamford, Conn.

[21] Appl. No.: 135,819

[22] Filed: Dec. 21, 1987

[51] Int. Cl.[4] ..... G03G 21/00

[52] U.S. Cl. ..... 355/15; 118/652; 15/256.52; 355/3 BE

[58] Field of Search ..... 355/15, 3 R, 3 DD, 3 BE; 118/652; 430/125; 15/256.5, 256.51, 256.52

[56] References Cited

U.S. PATENT DOCUMENTS

| | | | |
|---|---|---|---|
| 4,364,660 | 12/1982 | Oda | 355/15 |
| 4,501,620 | 2/1985 | Oda | 355/15 X |
| 4,522,487 | 6/1985 | Misawa | 355/15 |
| 4,639,119 | 1/1987 | Isaka | 355/15 X |

*Primary Examiner*—R. L. Moses

*Attorney, Agent, or Firm*—Mark Costello

[57] ABSTRACT

Toner removal device for removing residual toner and debris from a charge retentive surface after transfer of toner images from the surface. This device is characterized by an integral extruded multi-vaned toner transport member for vertical removal of toner accumulated at a cleaning blade chiselingly removing toner from the charge retentive surface and transporting toner from the area about the blade to a augering transport device for transporting toner to a sump.

14 Claims, 4 Drawing Sheets

ROTATING VANE TONER TRANSPORT FOR BLADE CLEANING ON HORIZONTAL SURFACES

This invention relates to reproduction apparatus and more particularly to cleaning apparatus for removing residual toner from a charge retentive surface where gravity will not transport toner removed from the surface to an auger.

BACKGROUND OF THE INVENTION

In electrophotographic applications such as xerography, a charge retentive surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known and useful for light lens copying from an original and printing applications from electronically generated or stored originals, where a charged surface may be imagewise discharged in a variety of ways.

Although a preponderance of the toner forming the image is transferred to the paper during the transfer step, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

Blade cleaning is a highly desirable method for removal of residual toner from a charge retentive surface. In such an arrangement, a blade is provided and supported adjacent to the charge retentive surface with a blade edge chiseling toner from contact with the surface. Subsequent to removal from the surface, toner is transported away from the blade area by a toner transport arrangement. Blade cleaning arrangements are very effective, and inexpensive relative to other cleaning devices, and serviceable over the device lifetime. Variations in lubricants and materials allow the use of blade cleaning at relatively high surface velocity.

Removal of accumulating toner from the blade area may be accomplished in a variety of ways, each dependent on the machine arrangement. While a cleaning arrangement for a more or less vertical surface may allow toner to simply fall from the blade area to a toner transport device, positioning the cleaning arrangement on a horizontal surface, sometimes referred to as twelve o'clock cleaning, requires direct removal of toner from the surface. Possible methods of transporting cleaned toner from the surface include air flow or vacuum transport, electric or magnetic transport, or mechanical transport. Air flow or vacuum transport offers an effective, but costly manner of moving toner. Electrical or magnetic systems, such as, for example, U.S. Pat. No. 4,398,820 to Thayer, are also costly, and depend on a well controlled charge state of the toner. Mechanical transports offer the best compromise for cost and reliability.

Typically, toner might be removed from the blade area either by a brush arrangement which transports toner generally vertically from the surface to a transport arrangement for removal to another area, such as shown, for example, in U.S. Pat. No. 4,427,289 to Oda, or directly by an augering arrangement, such as shown, for example, in U.S. Pat. No. 4,329,044 to Kitajium et al. and U.S. Pat. No. 3,917,398 to Takahashi et al., which move toner off the edge of the photoreceptor with an augering arrangement, or U.S. Pat. No. 3,951,542 to Ito et al. which similarly moves toner by an augering arrangement to the edge of a photoreceptor, to a multivaned direction changing member. Movement of the toner off the edge of the photoreceptor creates significant problems in toner contamination through the machine. For this reason, it is desirable when possible to remove toner generally vertically from the charge retentive surface.

Brush toner removal arrangements, such as shown in U.S. Pat. No. 4,427,289 to Oda, while in use, create significant problems. Toner is accumulated in the brush fibers, requiring periodic removal for cleaning or replacement. Detoning rolls must be provided to remove toner from the brush. The time that toner is in contact with the brush fibers must be minimized to avoid triboelectric charge transfer between toner and the brush fibers, which varies the removability of the toner. Additionally, the brush itself is not an inexpensive device to manufacture.

Thayer, "Photoreceptor Toner Cleaning Member," Xerox Disclosure Journal, Vol. 4, No. 5, September-/October 1979 discloses a ribbed cleaning member directly contacting a photoreceptor surface to wipe and flick toner therefrom. The surface is supported on a compressible core so that the member may be compressed in contact with photoreceptor. U.S. Pat. No. 4,360,944 to Iwai et al. shows a toner transport direction changing device including a single elastic plate member which moves toner through a housing from an output end of an auger to an input for a belt conveyor. U.S. Pat. No. 4,571,066 to Morrison describes a toner removal arrangement utilizing a compliant foam roll for removal of toner from the imaging surface, and a toner transport grid form on a non-imaging area of the photoreceptor for removal of the toner from the compliant foam roll for return on the photoconductive drum to the developing station. U.S. Pat. No. 4,323,306 to Ito et al. shows a cleaning device for removal of remaining developer from the surface of an image bearing member including a screw member operable to move toner away from a chiseling blade member in contact with the image bearing member. DE 32 07-900A to Kaspers shows an plastic cover of a cleaning roller formed with a star shaped interior conforming to vanes on a supporting inner core.

SUMMARY OF THE INVENTION

In accordance with the invention there is provided an improved cleaning device for removal of toner and debris from a charge retentive surface or photoreceptor surface and transport of removed toner to a toner sump.

In a cleaning arrangement for the removal of residual toner from a charge retentive surface, such as a photoreceptor surface in a reproduction machine, after a transfer step, a cleaning blade supported within a cleaning housing is arranged transversely across a horizontal portion of the surface to chiselingly remove toner electrostatically and mechanically held thereto. Removed toner accumulating in the area adjacent to the cleaning blade is removed therefrom with a multi-vaned toner removal member, which carries toner generally vertically upwardly from the charge retentive surface through a cleaning housing to a toner transport arrangement, which transports toner from the cleaning housing to a toner sump for reuse or disposal.

In accordance with one aspect of the invention, the multi-vaned toner removal member may be a generally cylindrical plastic extrusion, forming an endless surface, provided with a plurality of somewhat flexible vanes or blades arranged around the exterior circumferential surface thereof, supported for rotation within a cleaning housing, with the vanes extending transversely across the direction of travel of the photoreceptor surface. During the rotating movement of the multi-vaned toner removal member, the vanes rotate through the cleaning blade area and the cleaning housing, slightly impinging on the interior surface of the cleaning housing to provide a series of chambers carrying toner therethrough. An advantageous cleaning housing provides a generally cylindrical interior surface, with an opening adjacent to the photoreceptor surface for the collection of toner and a recess supporting a toner removal auger suitable for transport of toner deposited therein to a sump. Continuous movement of the vanes through the vicinity of the cleaning blade removes residual toner collecting thereat, carrying the toner through the housing to the a toner removal arrangement.

Substitution of the extruded multi-vaned toner removal member for standard brush toner removal members allows significant manufacturing and cost advantages. There is no requirement for a detoning roll, the problems associated with triboelectric charge transfer are minimized, and the extruded member will probably not require cleaning. Associated improvements in the structure of the cleaning housing also allow improved operation of the inventive cleaning arrangement.

In accordance with yet another aspect of the invention, the vanes and the plastic extrusion supporting the vanes may be varied in shape to improve toner direction into the auger. Additionally, the interior surface of the cleaner housing may be provided with ridges to flick or vibrate the vanes to assist in the removal of toner therefrom.

These and other aspects of the invention will become apparent from the following description used to illustrate a preferred embodiment of the invention read in conjunction with the accompanying drawings in which.

Figure 1:
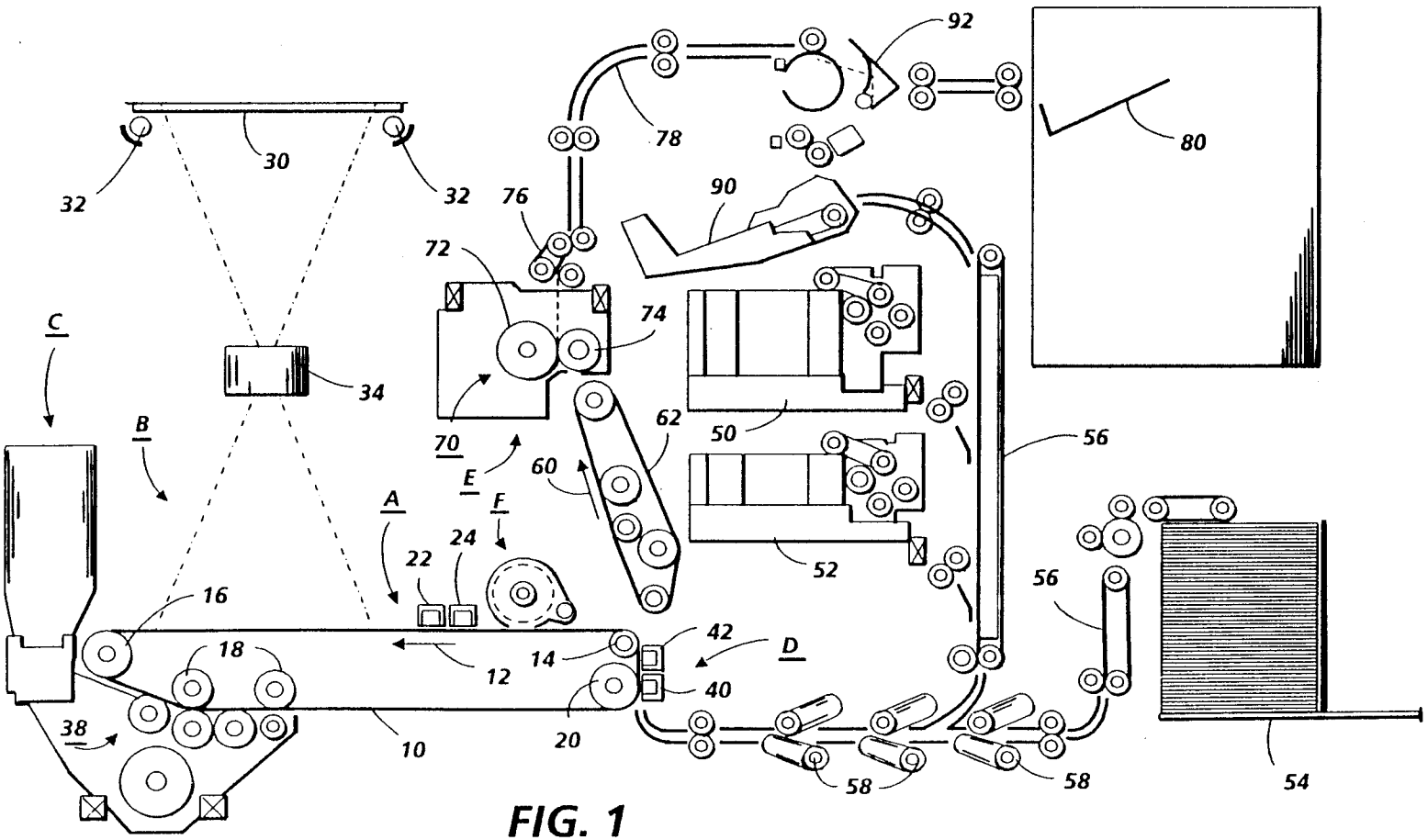
FIG. 1 is a schematic elevational view depicting an electrophotographic printing machine incorporating the present invention.

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original. Accordingly, a reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 18 and tension roller 16 are rotatably mounted. These rollers are idlers which rotate freely as belt 10 moves in the direction of arrow 16.

With continued reference to FIG. 1, initially a portion of belt 10 passes through charging station A. At charging station A, a pair of corona devices 22 and 24 charge photoreceptor belt 10 to a relatively high, substantially uniform negative potential.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, belt 10 advances the electrostatic latent image to development station C. At development station C, a magnetic brush developer unit 38 advances a developer mix (i.e. toner and carrier granules) into contact with the electrostatic latent image. The latent image attracts the toner particles from the carrier granules thereby forming toner powder images on photoreceptor belt 10.

Belt 10 then advances the developed latent image to transfer station D. At transfer station D, a sheet of support material such as a paper copy sheet is moved into contact with the developed latent images on belt 10. First, the latent image on belt 10 is exposed to a pretransfer light from a lamp (not shown) to reduce the attraction between photoreceptor belt 10 and the toner powder image thereon. Next corona generating device 40 charges the copy sheet to the proper potential so that it is tacked to photoreceptor belt 10 and the toner powder image is attracted from photoreceptor belt 10 to the sheet. After transfer, a corona generator 48 charges the copy sheet to an opposite polarity to detack the copy sheet for belt 10, whereupon the sheet is stripped from belt 10 at stripping roller 14.

Sheets of support material are advanced to transfer station D from supply trays 50, 52 and 54, which may hold different quantities, sizes and types of support materials. Sheets are advanced to transfer station D along conveyor 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet.

After fusing, copy sheets bearing fused images are directed through decurler 76. Chute 78 guides the advancing sheet from decurler 76 to catch tray 80 or a finishing station for binding, stapling, collating etc. and removal from the machine by the operator. Alternatively, the sheet may be advanced to a duplex tray 90 from duplex gate 92 from which it will be returned to the processor and conveyor 56 for receiving second side copy.

It is contemplated that residual toner remaining on photoreceptor belt 10 after transfer will be reclaimed and returned to the developer station C by any of several well known reclaim arrangements, and in accordance with the present invention, described below.

As thus described, a reproduction machine in accordance with the present invention may be any of several well known devices. Variatoins may be expected in specific processing, paper handling and control arrangements without affecting the present invention.

Figure 2:
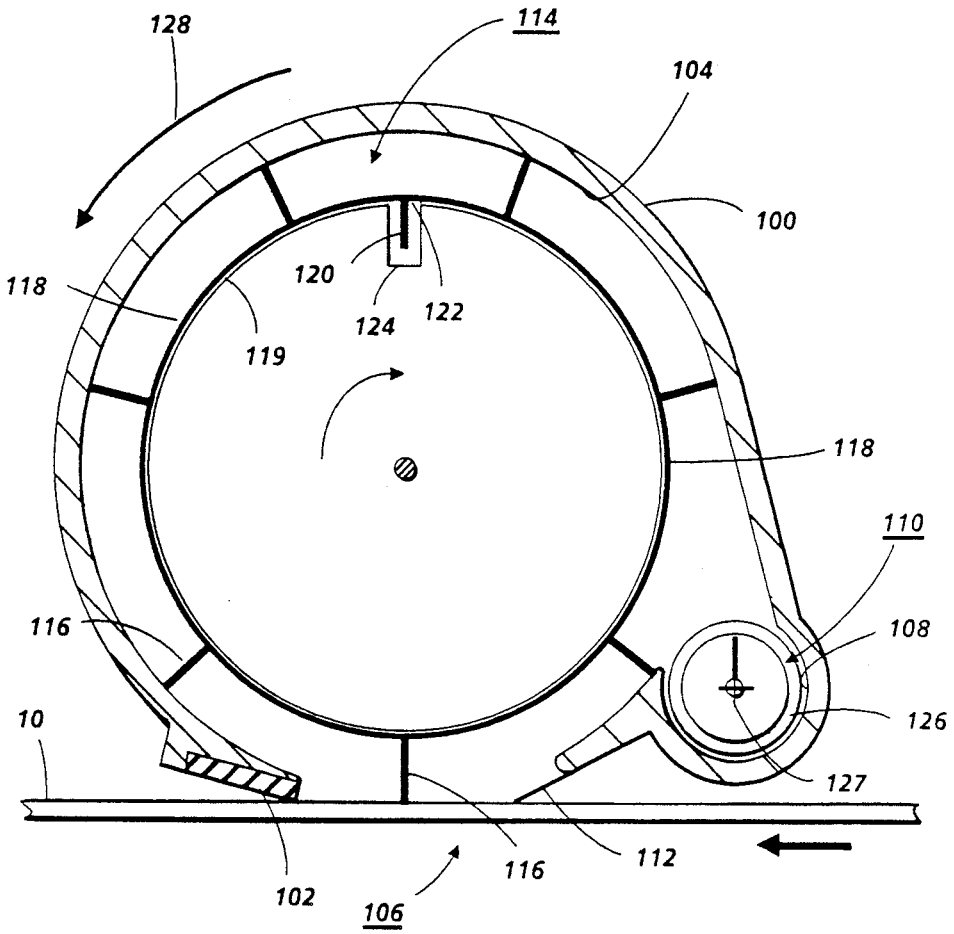
FIG. 2 is a schematic illustration of a cleaner in accordance with the present invention incorporated in the machine of FIG. 1.

In accordance with the invention, and with reference to Figure 2, cleaning station F is generally comprised of a cleaning housing 100, in which a cleaning blade 102 is supported for chiseling removal of residual toner from photoreceptor belt 10 remaining after transfer. Removed toner accumulates in the area immediately adjacent and upstream to cleaning blade 102, prevented from passing by the cleaning housing 100 by sealing engagement of the cleaning blade 102 with the photoreceptor. Cleaning housing 100 may advantageously be formed from a unitary extrusion having a generally cylindrical interior surface 104, with an opening 106 therein and extending across and adjacent to photoreceptor belt 10 for removal of toner therefrom, and a contoured recess 108 supporting a toner transport arrangement generally indicated as 110, as will be explained more completely hereinbelow. Any gap between housing 100 and photoreceptor belt 10 on the upstream side of the cleaning housing may be closed with a film seal 112 extending from the housing to sealing contact with photoreceptor belt 10.

Multi-vaned toner removal member 114 provides an endless surface, supported for rotating movement past blade 102 and through cleaning housing 100, with a generally clindrical shape and a plurality of parallel vanes or blades 116 supported about an exterior circumferential surface 118, extending across the member and generally parallel to cleaning blade 102. Vanes 116 extend perpendicularly outwardly from surface 118 to slightly impinge on cylindrical interior surface 104 of cleaning housing 100 as the vanes are moved therethrough and thereby maintain a sealing engagement with interior surface 104 for the transport of toner through housing 100. Multi-vane toner transport member 114 may be a sleeve shaped extrusion, supported over a sleeve support shaft 119 journaled for carrying the multi-vane toner transport member 114 in its rotating motion. The multi-vane toner transport member 114 may be provided with an vane nib 120 on its interior surface 122, which is seated in a complementary vane nib receiving slot 124 in support shaft 119, for fixed support of the sleeve thereon. The endless surface of the transport member may have a shape other than cylindrical, so long as it generally conforms with the shape of interior surface 104 to provide vanes 116 in sealing contact with interior surface 104 as the vanes are moved through housing 100. Drive means (not shown) such as a motor or a gear arrangement are provided for rotation of the support shaft.

Conveniently, the multi-vane toner transport member 114 and vanes 116 may be an integral extrusion. To minimize frictional heating, the vanes are of a plastic material, such as polyethylene. The vanes are thin in cross-section to dissipate heat quickly, approximately 0.5 mm or greater to allow extrusion manufacture of the member, although for other non-extruded arrangements the vanes may be thinner. The vane member rotates through housing 100 relatively slowly, with the speed selected as a function of photoreceptor velocity and toner accumulation at the blade, and in the range of approximately 1–20 RPM, for example, with greater or lesser speeds not excluded.

Toner chiseled from photoreceptor belt 10 and collected in the area adjacent cleaning blade 102, is carried through housing 100 and deposited in recess 108 supporting toner removal arrangement 110. Toner transport arrangement 110 includes auger 126 supported for rotating movement for transporting toner deposited in the auger recess 108 therealong to a toner sump or for recirculation to the developer station.

In accordance with another aspect of the invention, cleaning blade 102 may advantageously be positioned immediately adjacent to opening 106 in housing 100, so that there is no gap thereinbetween for toner to collect. In such a case, cleaning blade 102 may form an integral extension of the cylindrical interior surface 104 of cleaning housing 100, in cleaning engagement with the photoreceptor belt, whereby the vanes 116 of multi-vaned toner removal member 114 will sweep across the substantially continuous surface formed by the integral cleaning blade 102 and cleaning housing interior surface 104 to remove accumulating toner.

In accordance with another aspect of the invention, the entire cleaning housing as described may be supported for pivoting movement about an axis 127 centered approximately on auger 126 in the counterclockwise direction indicated by arrow 128 towards photoreceptor belt 10. In this manner, the weight of cleaning housing 100 and the elements supported therein may serve to bias cleaning blade 102 into cleaning engagement with the photoreceptor. For this purpose, support shaft 119 may be weighted in accordance with the desired bias to be applied, which in a preferred embodiment might be approximately 10–40 grams per centimeter of blade length. It will no doubt be appreciated that multi-vane transport member 114 may be driven from the auger drive through a belt or gear arrangement.

Figure 3:
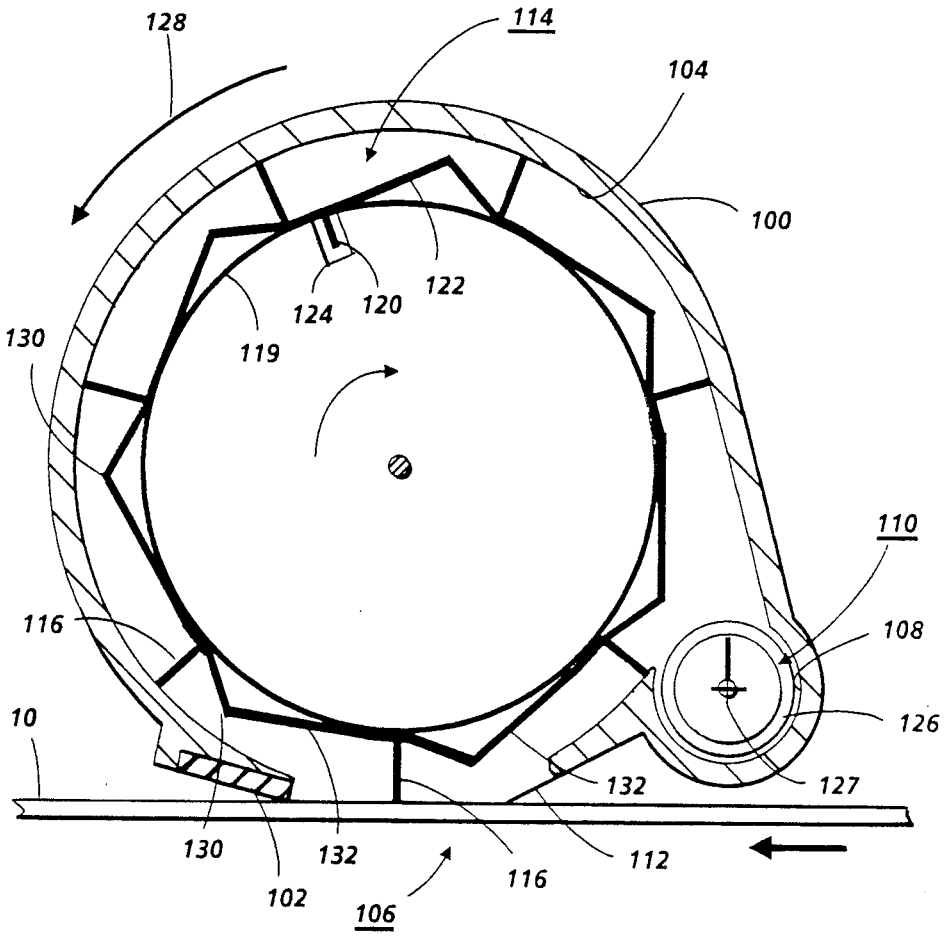
FIG. 3 depicts an alternative embodiment of a multi-vaned toner removal member in accordance with one aspect of the present invention.
Figure 4:
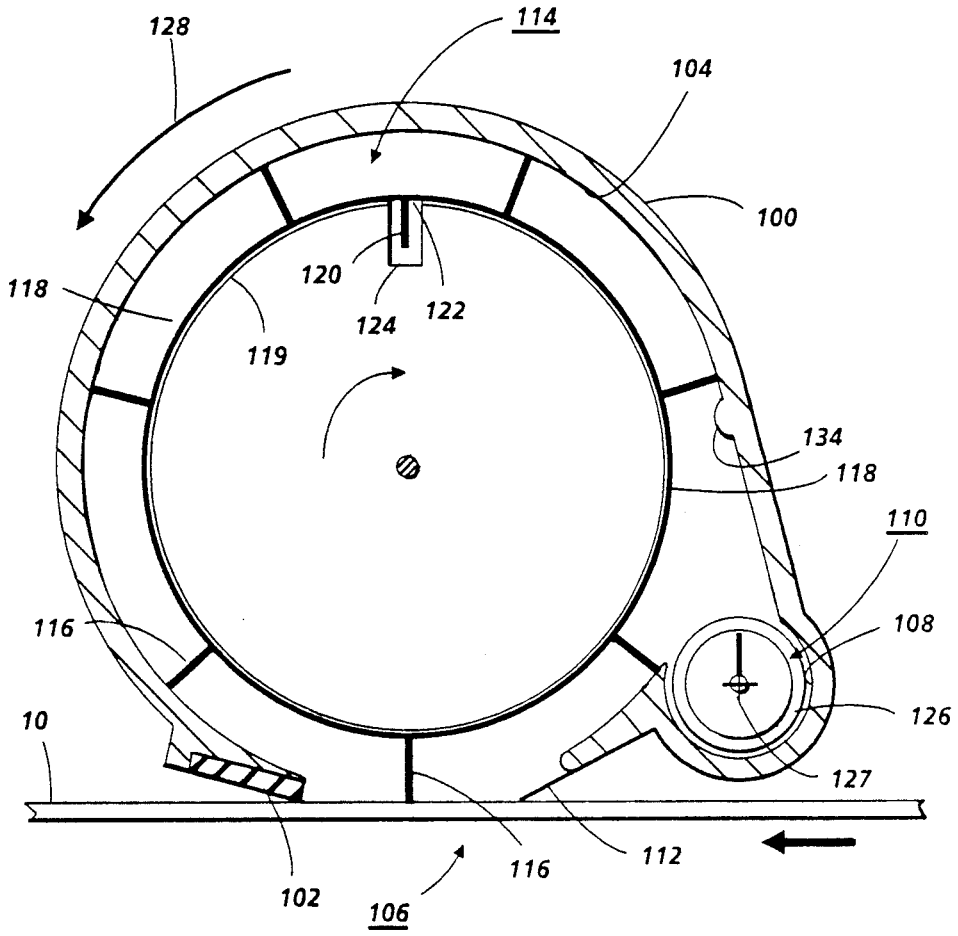
FIG. 4 shows another embodiment of a multi-vaned toner removal member in accordance with another aspect of the present invention.

In accordance with yet another aspect of the invention, Figures 3 and 4 show cross-sections of alternative embodiments of the present invention, where like features are provided with like numbering. FIG. 3 demonstrates the addition of ramps 130 formed on the exterior surface 132 of multi-vane toner transport sleeve 114, between each vane. These ramps serve to direct toner accumulated between the vanes into auger recess 108. The addition of ramps in the illustrated arrangement is easily accommodated in the extruded device. Other ramp-like structures may be desirable. FIG. 4 demonstrates the addition of a flicker bar in the form of a ridge 134 on cylindrical interior surface 104, which will contact the vanes on multi-vane toner transport sleeve 114 just prior to the vanes passing auger recess 108, to deflect the vanes 116 causing toner to be flicked into auger recess 108. A toner anti-bridging device (not shown), such as used in the Xerox 1090 copier, could be arranged in the space above the auger to prevent toner bridging, and be activated by both the auger and rotating vanes.

The invention has been described with reference to a preferred embodiment. Obviously modifications will occur to others upon reading and understanding the specification taken together with the drawings. This embodiment is but one example, and various alternatives modifications, variations or improvements may be made by those skilled in the art from this teaching which are intended to be encompassed by the following claims.

We claim:

1. Reproduction apparatus including a charge retentive surface; image forming means for forming a latent image on the charge retentive surface; means for developing the latent image with toner; transfer means for transferring the developed toner image from the charge retentive surface to a support surface; and cleaning means for removing residual toner from the charge retentive surface, said cleaning means comprising:

a cleaning blade supported within a cleaning housing for chiseling removal of toner from the charge retentive surface and accumulating removed toner adjacent thereto;

toner removal means for removal of toner from the area adjacent to the cleaning blade, including an endless surface supporting a plurality of somewhat flexible vanes arranged parallel to said cleaning blade and moving past said cleaning blade in sweeping abutment with the charge retentive surface, the cleaning blade, and an interior surface of the cleaning housing for movement of toner from said charge retentive surfave through said cleaning housing;

said endless surface formed by a generally cylindrical exterior surface of a sleeve member on a shaft journaled for rotating movement through said housing;

said sleeve member and shaft provided with complementary tab and receiving slot, for fixed support of the sleeve member on the rotating shaft; and toner transport means for receiving toner from the toner removal means and directing said toner to an output.

2. Reproduction apparatus including a charge retentive surface; image forming means for forming a latent image on the charge retentive surface; means for developing the latent image with toner; transfer means for transferring the developed toner image from the charge retentive surface to a support surface; and cleaning means for removing residual toner from the charge retentive surface, said cleaning means comprising:

a cleaning blade supported within a cleaning housing for chiseling removal of toner from the charge retentive surface and accumulating removed toner adjacent thereto;

toner removal means for removal of toner from the area adjacent to the cleaning blade, including an endless surface supporting a plurality of somewhat flexible vanes arranged parallel to said cleaning blade and moving past said cleaning blade in sweeping abutment with the charge retentive surface, the cleaning blade, and an interior surface of the cleaning housing for movement of toner from said charge retentive surface through said cleaning housing;

said endless surface formed by an exterior surface of a sleeve member, supported for movement through said housing;

said sleeve member formed from a plastic extrusion with said vanes formed integrally thereon; and toner transport means for receiving toner from the toner removal means and directing said tner to an output.

3. Reproduction apparatus including a charge retentive surface; image forming means for forming a latent image on the charge retentive surface; means for developing the latent image with toner; transfer means for transferring the developed toner image from the charge retentive surface to a support surface; and cleaning means for removing residual toner from the charge retentive surface, said cleaning means comprising:

a cleaning blade supported within a cleaning housing for chiseling removal of toner from the charge retentive surface and accumulating removed toner adjacent thereto;

toner removal means for removal of toner from the area adjacent to the cleaning blade, including an endless surface supporting a plurality of somewhat flexible vanes arranged parallel to said cleaning blade and moving past said cleaning blade in sweeping abutment with the charge retentive surface, the cleaning blade, and an interior surface of the cleaning housing for movement of toner from said charge retentive surface through said cleaning housing;

said endless surface formed by a generally cylindrical exterior surface of a sleeve member on a shaft journaled for rotating movement through said housing, said sleeve member formed from a plastic extrusion with said vanes formed integrally thereon; and toner transport means for receiving toner from the toner removal means and directing said toner to an output.

4. Reproduction apparatus including a charge retentive surface; image forming means for forming a latent image on the charge retentive surface; means for developing the latent image with toner; transfer means for transferring the developed toner image from the charge retentive surface to a support surface; and cleaning means for removing residual toner from the charge retentive surface, said cleaning means comprising:

a cleaning blade supported within a cleaning housing for chiseling removal of toner from the charge retentive surface and accumulating removed toner adjacent thereto;

toner removal means for removal of toner from the area adjacent to the cleaning blade, including an endless surface supporting a plurality of somewhat flexible vanes arranged parallel to said cleaning blade and moving past said cleaning blade in sweeping abutment with the charge retentive surface, the cleaning blade, and an interior surface of the cleaning housing for movement of toner from said charge retentive surface through said cleaning housing;

said cleaning housing supported adjacent to said charge retentive surface for pivoting movement in a direction biasing said blade into engagement with said charge retentive surface; and toner transport means for receiving toner from the toner removal means and directing said toner to an output.

5. Reproduction apparatus including a charge retentive surface; image forming means for forming a latent image on the charge retentive surface; means for developing the latent image with toner; transfer means for transferring the developed toner image from the charge retentive surface to a support surface; and cleaning means for removing residual toner from the charge retentive surface, said cleaning means comprising:

a cleaning blade supported within a cleaning housing for chiseling removal of toner from the charge retentive surface and accumulating removed toner adjacent thereto;

toner removal means for removal of tner from the area adjacent to the cleaning blade, including an endless surface supporting a plurality of somewhat flexible vanes arranged parallel to said cleaning blade and moving past said cleaning blade in sweeping abutment with the charge retentive surface, the cleaning blade, and an interior surface of the cleaning housing for movement of toner from said charge retentive surface through said cleaning housing;

said cleaning blade integrally supported on said cleaning housing, whereby said cleaning blade and said interior surface of the cleaning housing form a substantially continuous surface; and toner transport means for receiving toner from the toner removal means and directing said toner to an output.

6. Apparatus as defined in claim 5, wherein said cleaning housing is supported adjacent to said charge retentive surface for pivoting movement in a direction biasing said blade into engagement with said charge retentive surface.

7. Reproduction apparatus including a charge retentive surface; image forming means for forming a latent image on the charge retentive surface; means for developing the latent image with toner; transfer means for transferring the developed toner image from the charge retentive surface to a support surface; and cleaning means for removing residual toner from the charge retentive surface, said cleaning means comprising:

a cleaning housing having a generally cylindrical interior surface, and provided with an opening adjacent to the charge retentive surface;

a cleaning blade supported within the cleaning housing, adjacent the opening, for chiseling removal of toner from the charge retentive surface and accumulating removed toner adjacent thereto;

toner removal means for removal of toner from the area adjacent to the cleaning blade, including an endless generally cylindrical surface supporting a plurality of somewhat flexible blades arranged parallel to the cleaning blade and moving past the cleaning blade in sweeping abutment with the charge retentive surface, the cleaning blade, and an interior surface of the cleaning housing for movement of toner from said charge retentive surface through said cleaning housing about said generally cylindrical interior surface;

said endless surface formed by a generally cylindrical exterior surface of a sleeve member supported on a shaft journaled for rotating movement through said housing;

said sleeve member and shaft alternatively provided with either of a complementary tab and a receiving slot, for fixed support of the sleeve member on the rotating shaft; and toner transport means supported within a recess formed in the generally cylindrical interior surface of the cleaning housing for receiving toner from the toner removal means and directing received toner to an output.

8. Reproduction apparatus including a charge retentive surface; image forming means for forming a latent image on the charge retentive surface; means for developing the latent image with toner; transfer means for transferring the developed toner image from the charge retentive surface to a support surface; and cleaning means for removing residual toner from the charge retentive surface, said cleaning means comprising:

a cleaning housing having a generally cylindrical interior surface, and provided with an opening adjacent to the charge retentive surface;

a cleaning blade supported within the cleaning housing, adjacent the opening, for chiseling removal of toner from the charge retentive surface and accumulating removed toner adjacent thereto;

toner removal means for removal of toner from the area adjacent to the cleaning blade, including an endless generally cylindrical surface supporting a plurality of somewhat flexible blades arranged parallel to the cleaning blade and moving past the cleaning blade in sweeping abutment with the charge retentive surface, the cleaning blade, and an interior surface of the cleaning housing for movement of toner from said charge retentive surface through said cleaning housing about said generally cylindrical interior surface;

said endless surface formed by a generally cylindrical exterior surface of a sleeve member supported on a shaft journaled for rotating movement through said housing;

said sleeve member formed from a plastic extrusion with said vanes formed integrally thereon; and toner transport means supported within a recess formed in the generally cylindrical interior surface of the cleaning housing for receiving toner from the toner removal means and directing received toner to an output.

9. Reproduction apparatus including a charge retentive surface; image forming means for forming a latent image on the charge retentive surface; means for developing the latent image with toner; transfer means for transferring the developed toner image from the charge retentive surface to a support surface; and cleaning means for removing residual toner from the charge retentive surface, said cleaning means comprising:

a cleaning housing having a generally cylindrical interior surface, and provided with an opening adjacent to the charge retentive surface;

a cleaning blade supported within the cleaning housing, adjacent the opening, for chiseling removal of toner from the charge retentive surface and accumulating removed toner adjacent thereto;

said cleaning housing supported adjacent to said charge retentive surface for pivoting movement in a direction biasing said blade into engagement with said charge retentive surface;

toner removal means for removal of toner from the area adjacent to the cleaning blade, including an endless generally cylindrical surface supporting a plurality of somewhat flexible blades arranged parallel to the cleaning blade and moving past the cleaning blade in sweeping abutment with the charge retentive surface, the cleaning blade, and an interior surface of the cleaning housing for movement of toner from said charge retentive surface through said cleaning housing about said generally cylindrical interior surface; and toner transport means supported within a recess formed in the generally cylindrical interior surface of the cleaning housing for receiving toner from the toner removal means and directing received toner to an output.

10. Reproduction apparatus including a charge retentive surface; image forming means for forming a latent image on the charge retentive surface; means for developing the latent image with toner; transfer means for transferring the developed tner image from the charge retentive surface to a support surface; and cleaning means for removing residual toner from the charge retentive surface, said cleaning means comprising:

a cleaning housing having a generally cylindrical interior surface, and provided with an opening adjacent to the charge retentive surface;

a cleaning blade supported within the cleaning housing, adjacent the opening, for chiseling removal of toner from the charge retentive surface and accumulating removed toner adjacent thereto;

said cleaning blade integrally supported on said housing, whereby said cleaning blade and said interior surface of the cleaning housing form a substantially continuous surface;

toner removal means for removal of toner from the area adjacent to the cleaning blade, including an endless generally cylindrical surface supporting a plurality of somewhat flexible blades arranged parallel to the cleaning blade and moving past the cleaning blade in sweeping abutment with the charge retentive surface, the cleaning blade, and an interior surface of the cleaning housing for movement of toner from said charge retentive surface through said cleaning housing about said generally cylindrical interior surface; and toner transport means supported within a recess formed in the generally cylindrical interior surface of the cleaning housing for receiving toner from the toner removal means and directing received toner to an output.

11. Reproduction apparatus including a charge retentive surface; image forming means for forming a latent image on the charge retentive surface; means for developing the latent image with toner; transfer means for transferring the developed tner image from the charge retentive surface to a support surface; and cleaning means for removing residual toner from the charge retentive surface, said cleaning means comprising:

a cleaning housing having a generally cylindrical interior surface, and provided with an opening adjacent to the charge retentive surface;

a cleaning blade integrally supported within the cleaning housing, adjacent the opening, for chiseling removal of toner from the charge retentive surface and accumulating removed toner adjacent thereto, and forming a substantially continuous surface with the housing interior surface;

a multi-vaned toner transport member, supported for rotational movement through the cleaning housing, having a generally cylindrical shape and a plurality of somewhat flexible vanes formed integrally thereon and about parallel to the cleaning blade, and moving past the cleaning blade in sweeping abutment with the charge retentive surface, the cleaning blade, and an interior surface of the cleaning housing for movement of toner from said charge retentive surface through said cleaning housing about said generally cylindrical interior surface; and toner transport means supported within a recess formed in the generally cylindrical interior surface of the cleaning housing for receiving toner from the toner removal means and directing received toner to an output.

12. Apparatus as defined in claim 11, wherein the endless surface is formed by a generally cylindrical exterior surface of a sleeve member supported on a shaft journaled for rotating movement through said housing.

13. Apparatus as defined in claim 12 wherein said sleeve member and shaft are alternatively provided with either of a complementary tab and a receiving slot, for fixed support of the sleeve member on the rotating shaft.

14. Apparatus as defined in claim 11, wherein said cleaning housing is supported adjacent to said charge retentive surface for pivoting movement in a direction biasing said blade into engagement with said charge retentive surface.

* * * * *